US005209407A

United States Patent [19]

Farrington

[11] Patent Number: 5,209,407

[45] Date of Patent: May 11, 1993

[54] SPRAY NOZZLE FOR ELECTRIC IRON

[75] Inventor: Richard I. Farrington, Seymour, Conn.

[73] Assignee: Black & Decker Inc., Newark, Del.

[21] Appl. No.: 822,807

[22] Filed: Jan. 21, 1992

[51] Int. Cl.[5] ..... B05B 1/34; D06F 75/22

[52] U.S. Cl. ..... 239/491; 239/493; 38/77.5

[58] Field of Search ..... 239/486, 490, 491, 494, 239/493, 496; 38/77.5, 77.1

[56] References Cited

U.S. PATENT DOCUMENTS

| | | | |
|---|---|---|---|
| 2,577,901 | 12/1951 | Marlow | 239/491 |
| 3,025,005 | 3/1962 | Dafforn et al. | 239/496 |
| 3,129,893 | 4/1964 | Green | 239/490 |
| 3,344,541 | 10/1967 | Trouilhet | 38/77.1 |
| 3,373,516 | 3/1968 | Knapp et al. | 38/77.5 |
| 3,552,046 | 1/1971 | Phifer | 38/77.5 |
| 3,881,265 | 5/1975 | Eaton et al. | 38/77.5 |
| 4,087,050 | 5/1978 | Tsuji et al. | 239/490 |
| 4,128,206 | 12/1978 | Bintner | 239/11 |
| 5,136,796 | 8/1992 | Farrington | 38/77.5 |

*Primary Examiner*—Andres Kashnikow

*Assistant Examiner*—Karen B. Merritt

*Attorney, Agent, or Firm*—Barry E. Deutsch

[57] ABSTRACT

A spray nozzle for an electric iron includes a nozzle cap having an outlet orifice formed in an end wall thereof. The cap includes an axially extending cylindrical wall defining an axially extending bore. A fluid delivery tube is provided in the bore. The inside surface of the end wall includes at least two circumferentially spaced raised pads. The sides of adjacent pads define slots therebetween. A substantially flat disc-like member is disposed in the bore adjacent the pads. The diameter of the member is somewhat less than the diameter of the bore to define a circumferentially extending groove. The opposed surfaces of the end wall and the member define a cavity. The pads define the radially inner circumferential border of the cavity. The slots formed between adjacent pads are disposed on lines that are tangent to the cavity. The end of the fluid delivery tube is notched to form "V"-shaped surfaces. The ends of the legs of the "V" are in engagement with the confronting surface of the disc-like member to move the member into engagement with the pads.

4 Claims, 2 Drawing Sheets

SPRAY NOZZLE FOR ELECTRIC IRON

BACKGROUND OF THE INVENTION

This invention relates to electric irons and in particular to a nozzle for spraying water onto the garment being ironed while the iron is being used.

In the field of electric irons of the type that are commonly used in the modern household, many of the irons include means to emit a spray of water droplets onto the object to be ironed which is positioned in the path of movement of the iron. This spray function is used when ironing certain fabrics and the spray function is controlled by the user of the iron. The spray of water tends to relax the fabric being ironed and assists in removing wrinkles from the garment.

Most spray nozzles used on electric irons include a plastic body, a cap, a spring and a water spreader. Such spray nozzles may also include an O-ring seal. The multiplicity of small parts make the prior art spray nozzles relatively expensive to manufacture and difficult to assemble.

The spray nozzle of the invention provides a two-piece assembly which is relatively inexpensive to manufacture and may be readily assembled, thus reducing the overall cost of providing a spray function in electric irons.

Accordingly, it is an object of the present invention to provide a spray nozzle for an electric iron which is relatively inexpensive to manufacture and can be readily assembled.

SUMMARY OF THE INVENTION

The foregoing object and other objects of the invention are attained in a spray nozzle for an electric iron comprising a nozzle cap having an outlet orifice formed in an end wall thereof. The cap includes an axially extending cylindrical wall defining an axially extending bore. Fluid delivery means are provided in the bore. The inside surface of the end wall includes at least two circumferentially spaced raised pads, with ends of adjacent pads defining slots therebetween. A substantially flat disc-like member is disposed in the bore adjacent the pads. The diameter of the disc-like member is somewhat less than the diameter of the bore to form a circumferentially extending groove therebetween. The opposed surfaces of the end wall and the disc-like member define a cavity. The pads define a circumferential radially inner border of the cavity. The slots formed between adjacent pads are disposed on lines that are tangent to the cavity.

DESCRIPTION OF THE PREFERRED EMBODIMENT

Figure 1:
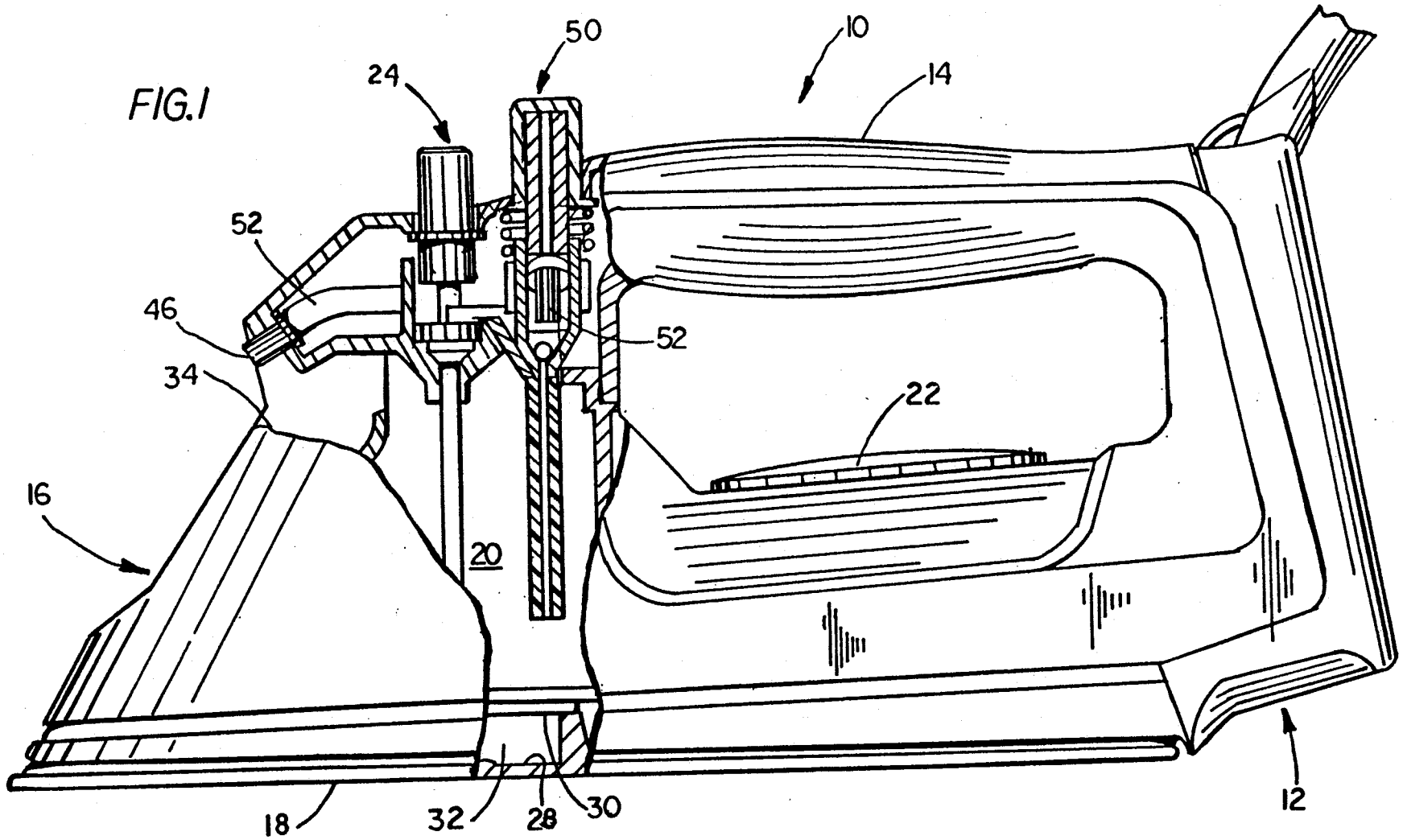
FIG. 1 is a side elevational view, partially in cross-section, of an electric steam iron incorporating a spray nozzle in accordance with the present invention.

Referring now to the various figures of the drawing, a preferred embodiment of the present invention shall be described in detail. In referring to the various figures, like numerals shall refer to like parts.

An electric steam iron including a spray nozzle in accordance with the present invention is illustrated in partial cross-section in FIG. 1 and is designated generally therein by the reference numeral 10. As shown, steam iron 10 includes a body portion 12, a handle 14 for enabling the user to manipulate the steam iron, a forward or nose portion 16, and an electrically heated soleplate 18. A water-containing reservoir 20 is formed within body portion 12 of steam iron 10 and contains a supply of water used for the generation of steam. As is well known in the art, steam iron 10 includes a fill port 34 by which reservoir 20 is periodically filled by the user. Reservoir 20 may include a translucent or transparent window (not shown) by which the level of water in the reservoir can be gauged by the user.

Steam iron 10 is provided with a user-operable temperature control 22 to regulate the electric power provided to soleplate 18. Temperature control 22 is connected to a thermostat (not shown) that periodically opens and closes an electric circuit to supply power to soleplate 18 and thus establish the ironing temperature of the soleplate.

Iron 10 includes a steam flow control knob 24 which controls the amount of steam issued from steam apertures (not shown) in soleplate 18 as is conventional in the art. Soleplate 18 includes an interior surface portion 28 that is closed by a coverplate 30 to define a steam chamber 32 in which water from reservoir 20 is flashed to steam. Steam chamber 32 is connected to passageway (not shown) that lead to the steam apertures formed in soleplate 18 to provide the steam to the fabric being ironed.

Iron 10 further includes a water spray nozzle 46 mounted at the forward or nose portion 16 of housing 12. Nozzle 46 enables the user of the iron to emit a spray of water droplets onto the object being ironed which is positioned in the path of movement of the iron. This spray function is used when ironing certain fabrics. A user operable control knob 50 extends above the top surface of iron 10 and is mounted within handle 14 for movement in either a rotational direction or in an axial direction relative to the handle. Knob 50 is included within a combination pump and spray or surge function selector valve more fully disclosed in co-pending application, Ser. No. 07/646,111 filed Jan. 28, 1991 in the name of Richard I. Farrington now U.S. Pat. No. 5,136,796 issued Aug. 11, 1992.

For the purposes of the description of the present invention, it should be understood that control knob 50 can be manipulated by the user to pump water through tubing 52 to spray nozzle 46.

Figure 3:
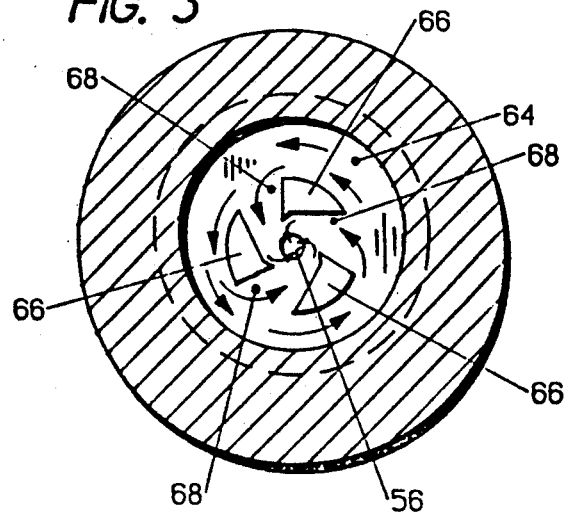
FIG. 3 is a plan view illustrating the inside surface of the end wall of the nozzle cap.
Figure 2:
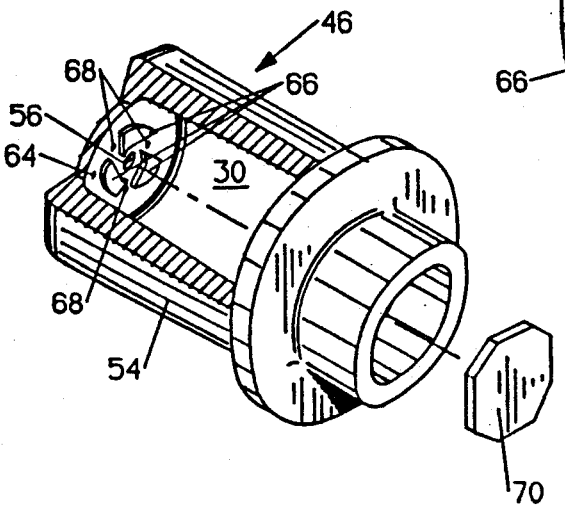
FIG. 2 is an exploded perspective view of the spray nozzle of the present invention.
Figure 4:
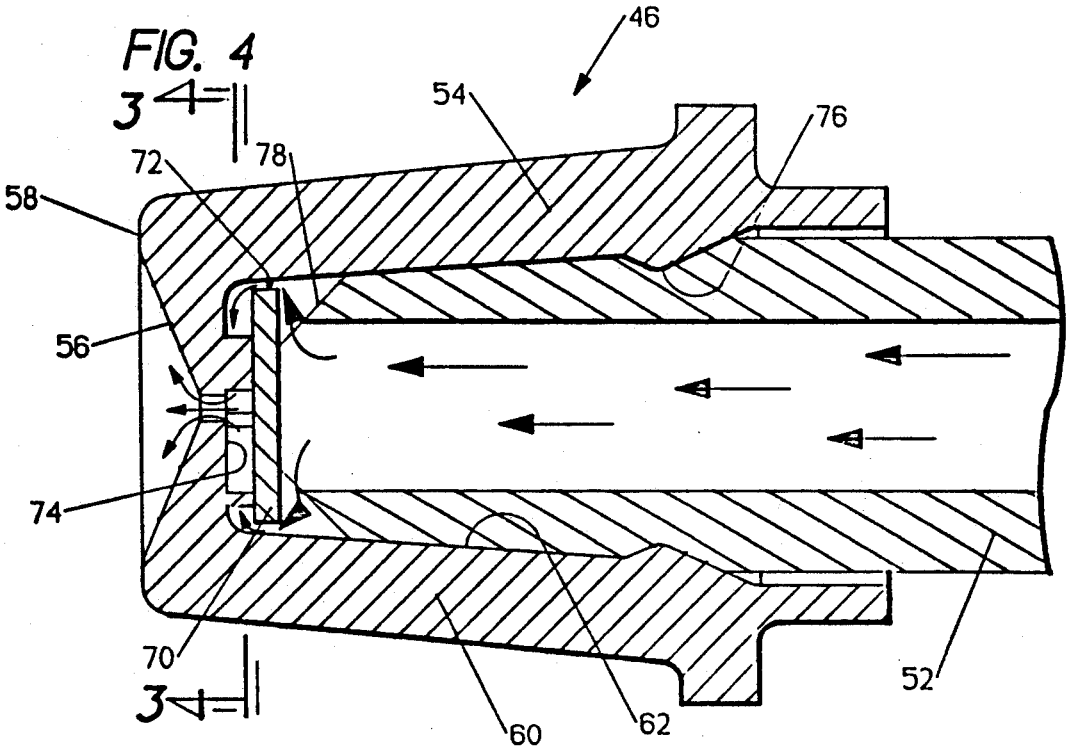
FIG. 4 is a longitudinally extending, cross-sectional view of the nozzle of the present invention.

Referring now to FIGS. 2–4, details of the spray nozzle of the present invention shall be more fully described. Spray nozzle 46 includes a nozzle cap 54 having an outlet orifice 56 formed in an end wall 58 thereof. Cap 54 includes an axially extending cylindrical wall 60 which defines an axially extending bore 62. One end of fluid delivery tube 52 is disposed in bore 62 of cap 54.

The inside surface 6 of end wall 58 includes at least two circumferentially spaced raised pads 66. In the preferred embodiment, three pads are formed. The sides of adjacent pads define slots 68 therebetween.

A substantially flat disc-like member 70 is disposed in bore 62 adjacent pads 66. The diameter of member 70 is somewhat less than the diameter of bore 62 to define a circumferentially extending groove 72 therebetween.

As particularly shown in FIG. 4, the opposed surfaces of end wall 58 and member 70 define a cavity 74 therebetween. Pads 66 define the radially inner circumferential border of cavity 74. Slots 68 formed between adjacent pads 66 are disposed on lines that are tangent to cavity 74.

As illustrated member 70 is octagonally shaped. However, the member may be made in any polygon shape or may even be circular. It has been found that for best operation member 70 should be made in a polygon shape as the pointed surfaces formed by the intersecting sides of the polygon tend to maintain member 70 centrally positioned within bore 62.

As illustrated in FIG. 4, in the preferred embodiment, cap 54 includes a radially inwardly extending flange 76 which engages the outer wall of tube 52 for a reason to be more fuller described hereinafter.

As also illustrated in FIG. 4, the end of tube 52 is notched to form a "V"-shaped surfaces 78. The ends of the legs of the "V" are in engagement with the confronting surface of disc-like member 70 to move the member into engagement with pads 66.

When the user of iron 10 desires to spray water onto the fabric being ironed, the user manipulates control button 50 so that water flows through tube 52. The water exits the tube and flows outwardly within bore 62 as directed by the confronting surface of disc-like member 70. The water flows through circumferential groove 72 into cavity 74 and thence through slots 68. As the slots are tangential to cavity 74 the water passing through the slots is directed through a spiral flow path to form the spray pattern for the water exiting through outlet orifice 56.

Inwardly extending radial flange 76 of nozzle cap 54 prevents the nozzle cap from "blowing off" the tube 52 as the tube is pressurized by the flow of water therethrough.

The spray nozzle of the present invention requires only two parts, namely cap 54 and member 70. The nozzle is thus relatively inexpensive to manufacture and may be readily assembled in iron 10.

While a preferred embodiment of the present invention has been described and illustrated, the invention should not be limited thereto, but may be otherwise embodied within the scope of the following claims.

What is claimed is:

1. A spray nozzle for an electric iron comprising:

a nozzle cap having an outlet orifice formed in an end wall thereof, said cap including an axially extending cylindrical wall defining an axially extending bore; the inside surface of said end wall of said nozzle cap including at least two circumferentially spaced raised pads having radially extending sides, with sides of adjacent pads defining slots therebetween;

a substantially flat disc-like member disposed in said bore adjacent to said pads, the diameter of said disc-like member being somewhat less than the diameter of said bore to define a circumferentially extending groove therebetween, the opposed surfaces of said end wall and said disc-like member defining a cavity therebetween, said pads defining the circumferentially radially inner border of said cavity, the slots formed between adjacent pads being disposed on a line tangent to the cavity; and fluid delivery means provided in said bore, said fluid delivery means comprising a tube, with the end of the tube adjacent to said disc-like member being notched to define "V"-shaped surfaces, the ends of the legs of the "V" contacting the confronting surface of the disc-like member to move the member into engagement with the pads.

2. A spray nozzle in accordance with claim 1 wherein the cylindrical wall of said nozzle cap includes a radially inwardly extending flange for maintaining the cap on the fluid delivery means when fluid is flowing therewithin.

3. An electric iron comprising:

a soleplate;

a housing connected to the soleplate;

a water reservoir associated with the housing and having a water inlet and at least one water outlet;

a pump connected to the water outlet;

a spray nozzle extending from a front wall of said housing;

fluid delivery means communicating the spray nozzle with an outlet from said pump;

said spray nozzle including a nozzle cap having an outlet orifice formed in an end wall thereof, said cap including an axially extending cylindrical wall defining an axially extending bore, said fluid delivery means being disposed in said bore;

the inside surface of said end wall including at least two circumferentially spaced raised pads having radially extending sides with sides of adjacent pads defining slots therebetween;

a substantially flat disc-like member disposed in said bore adjacent said pads, the diameter of said disc-like member being somewhat less than the diameter of said bore to define a circumferentially extending groove therebetween, the opposed surfaces of said end wall and said disc-like member defining a cavity therebetween, said pads defining the circumferential radially inner border of said cavity, the slots formed between adjacent pads being disposed on a line tangent to the cavity; and said fluid delivery means comprising a tube, with the end of the tube adjacent to said disc-like member being notched to define "V"-shaped surfaces, the ends of the legs of the "V" contacting the confronting surface of the disc-like member to move the member into engagement with the pads.

4. An electric iron in accordance with claim 3 wherein the cylindrical wall of said nozzle cap includes a radially inwardly extending flange for maintaining the cap on the fluid delivery means when fluid is flowing therewithin.

* * * * *